US005562310A

United States Patent [19]

Henry

[11] Patent Number: 5,562,310

[45] Date of Patent: Oct. 8, 1996

[54] SYSTEM FOR CORRECTING INFORMATION ON PRINTED MATERIAL AND METHOD THEREFOR

[76] Inventor: Carl S. Henry, 102 Ellsworth St., Newington, Conn. 06111

[21] Appl. No.: 494,392

[22] Filed: Jun. 26, 1995

[51] Int. Cl.[6] ..... B42D 15/00

[52] U.S. Cl. ..... 283/81; 283/117; 283/67

[58] Field of Search ..... 81/9.21; 283/81, 283/117, 67; 40/299; 428/40–42

[56] References Cited

U.S. PATENT DOCUMENTS

| | | | |
|---|---|---|---|
| 3,075,216 | 1/1963 | Wiener | 81/9.21 |
| 4,248,660 | 2/1981 | Johnson | 283/117 X |
| 5,024,332 | 6/1991 | Stachler | 283/81 X |
| 5,186,499 | 2/1993 | Mason | 283/81 |
| 5,316,344 | 5/1994 | Popat et al. | 283/81 |
| 5,418,026 | 5/1995 | Dronzek, Jr. et al. | 283/81 X |

OTHER PUBLICATIONS

Pertinent pages of Summer, 1995 Staples Catalogue.

*Primary Examiner*—Willmon Fridie, Jr.

[57] ABSTRACT

A system for correcting information on printed material using a supply of removable printed labels (10) or a supply of removable printable labels (18) with attached implement placement means (14) and method of application is disclosed. The system comprises a placement implement being attached by reusable attachment means (12) threaded through a hole (24) in the label supply and a hole (26) in the placement implement. The tapered end (16) of the implement is used to lift a printed label (20) from the backing sheet (22) and align it over inaccurate information on printed material. Pressing and adhering the label onto the inaccurate information thereby covers and corrects the inaccurate information.

5 Claims, 1 Drawing Sheet

SYSTEM FOR CORRECTING INFORMATION ON PRINTED MATERIAL AND METHOD THEREFOR

BACKGROUND—FIELD OF INVENTION

This invention relates to a system for correcting information on printed material by using removable printed or printable labels with attached implement placement means and method of application.

BACKGROUND—DESCRIPTION OF PRIOR ART

This invention relates to a system for correcting information on printed material by using removable printed or printable labels with implement placement means and method of application. These labels are commonly referred to as "peel and stick" or self-adhesive and contain a high temperature, stable, pressure sensitive adhesive which allows the passing of labels through high temperature printers without contamination of the printers. Heretofore, labels have not been sold with attached implement placement means. Generally, labels have been large enough to remove by hand and place in the desired location and with the desired alignment. In instances when the labels have been smaller, manual placement was cumbersome and inaccurate. When more control oven placement was needed, the user would need a tool suitable for such placement. A one-sided razor blade or an "X-ACTO" TM knife would have been common choices for this procedure. Because of their sharp edge, these tools presented the possibility of cutting the user. Because they were not attached to the labels, these tools could more easily be misplaced when desired to be used with the labels.

There exists situations when labels would, by design, be too small for easy and accurate manual placement. Because of increased demand for telephone numbers, many telephone companies have been forced to change the area code of existing customers to make more numbers available to new customers. Many of the existing customers are then left with a stock of printed material with an inaccurate area code. Such material could include stationery, promotional and product information. Such labels, used to cover and correct an inaccurate area code, consist of only three digits. These labels, when appropriately sized for their intended use could often be relatively diminutive.

This invention combines removable printed or printable labels with attached implement placement means to allow for accurate placement of labels. This meticulous placement enhances the appearance of the surfaces the labels are attached to. This invention consists of labels already printed with the desired information and blank, printable labels which the user can customize with the desired information, using a laser printer or other printing equipment. The labels of this invention are sufficiently thick and opaque so that the undesired information which is covered will not be visible through the labels.

OBJECTS AND ADVANTAGES

Accordingly, several objects and advantages of the present invention are:

It would thus be desirable to have removable printed or printable labels with an attached implement placement means.

Such an implement would, when the labels are too small for accurate manual manipulation, allow for more controlled placement by the user.

Such an implement, because it is attached to the labels, would be easier to find when its use is desired.

Such an implement, because its only intended purpose is the handling of labels, would not require a sharp cutting edge. This narrowness of purpose would make it cheaper to produce and safer than other tools, such as a one-sided razor blade or "X-ACTO" TM knife, which have sharp cutting edges.

It would be desirable to have labels pre-printed. When generic information, such as a new area code, can be used by a large number of people, it would be cost and labor effective to produce large quantities of generic labels.

It would be desirable to have blank, printable labels when the user needs to customize information. These labels could be used with a laser or other printing equipment.

It would be desirable to have the attached placement implement be detachable and attachable. Before the user desires to run blank printable labels through his printer, the user would detach the placement implement. After the labels are printed, the user would attach the placement implement. Should the user need an additional supply of printed labels, the user could purchase them, at a lower cost, without the placement implement, and attach the placement implement already owned.

DESCRIPTION OF INVENTION

The following specification taken in conjunction with the drawings sets forth the preferred embodiment of the present invention in such a manner that any person skilled in the art can make and use the invention. The embodiment of the invention disclosed herein is the best mode contemplated by the inventor for carrying out his invention in a commercial environment although it should be understood that various modifications can be accomplished within the parameters of the present invention.

Figure 1:
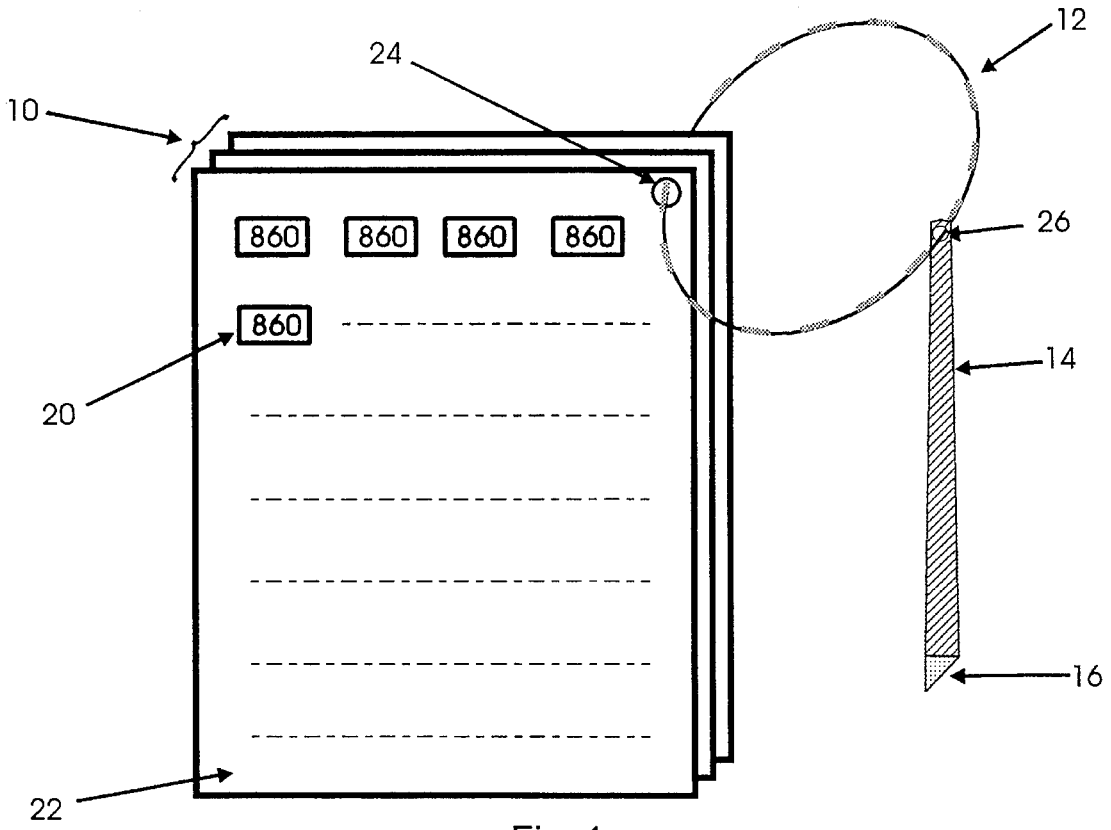
FIG. 1 is a diagram showing a supply of removable printed labels with an attached implement placement means.

A typical embodiment of the present invention is illustrated in FIG. 1. Here we see a diagram showing a supply of removable printed labels 10 with an attached placement implement means 14, a pencil-shaped tool with a tapered, elongated tip. The placement implement 14 is attached to the supply of removable printed labels 10 by reusable attachment means 12, which is threaded through a hole 24 in the label supply and a hole 26 in the implement. By removable attachment means, the inventor refers to devices such as, but not limited to, a metal or plastic key chain, or a releasable nylon tie such as those sold by the Associated Bag Company of Milwaukee, Wis. The placement implement 14 is of a design to allow for comfortable and accurate manual use. The inventor has fashioned a satisfactory prototype placement implement made of Plexiglas TM acrylic sheet. The dimensions are 5/16th inch wide, 4½ inch long and ⅜th inch thick. Although not intended to limit the design scope of the placement implement, which could, for example, include tweezers, this prototype is disclosed for general illustrative purposes. The placement implement contains an end area 16 tapered to a sufficient point and edge to facilitate removal of a removable printed label 20 from the backing sheet 22 but not sharp enough to present the possibility of cutting the user.

Although the reusable attachment means 12 is shown being threaded through a hole 24 in the label supply 10 and another hole 26 in the implement 14, the inventor recognizes that other methods of attachment are possible. For instance, a clamp or clasp could be used on one or both ends of the reusable attachment means 12. Also, one end of the reusable attachment means 12 could be molded to the placement implement 14.

Figure 2:
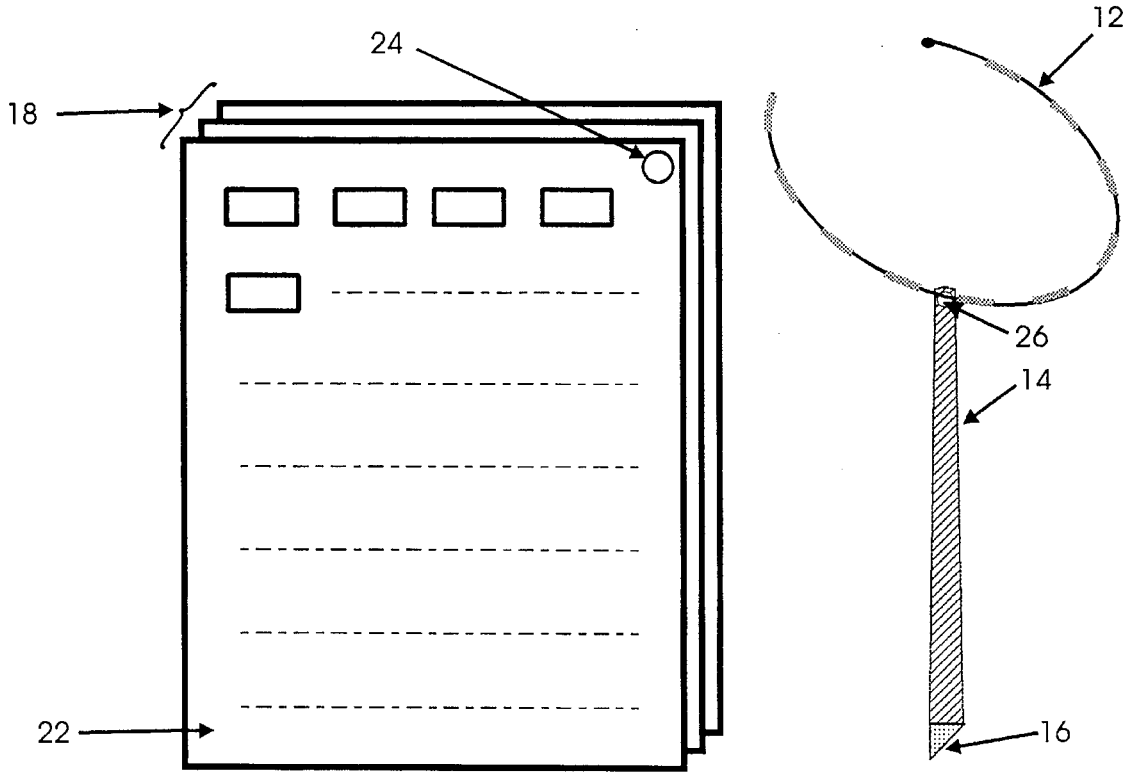
FIG. 2 is a diagram showing a supply of removable printable labels with an unattached implement placement means.

FIG. 2 is a diagram of a supply of removable printable labels 18 with a detached placement implement means 14. The printable labels 18 are blank and, because they are separated from the placement implement 14, suitable for use with a laser printer or other printing equipment in order to print customized information.

OPERATION OF INVENTION

It will be seen that in the preferred embodiment of FIG. 1, that when the placement implement means 14 is used to remove and place a printed label 20 from the removable printed label supply 10 onto a piece of printed material with obsolete or incorrect information, the user is able to enjoy easier and more controlled placement than the more clumsy and cumbersome use of hand only. It will b seen that the user of the present invention enjoys a clearer, less obstructed view of the printed material the user is attempting to correct. The placement implement 14, because of its slimmer profile compared to the user's hand, blocks less of the surface that the user is attempting to modify. The user therefore enjoys more accurate alignment of the label 20. It will be seen that, because the placement implement 14 contains an end area 16 tapered to a sufficient point and edge to facilitate removal of the label 20 from the supply but not sharp enough to present the possibility of cutting oneself, the user enjoys safer operation. This end area 16 will also allow the user to enjoy easier removal of the printed label 20 from she backing sheet 22 with less chance of damaging the label.

The user of the present invention will begin by chosing an appropriate supply of removable printed labels 10 that will contain the desired information and be of the appropriate size and typeset to most closely match the stock of existing printed material the user desires to correct. The user would then grasp the placement implement 14 in a manner that allows the user most control. Many users would find this manner to be similar to holding a writing implement such as a pencil or pen.

The user would then remove the printed label 20 from the supply by sliding the tapered end area 16 of the placement implement under the label 20 and lifting it from the backing sheet 22. Next the user would align the label 20 over the incorrect or obsolete information on the existing printed material and press the label onto the unwanted information, thus covering and concealing the undesired information with the label 20 containing the desired information.

Should the user desire to replenish the supply of removable printed labels 10, the user would detach the reusable attachment means 12 and thread it through the hole 24 in a new supply of removable printed labels.

It will also be seen in another preferred embodiment of FIG. 2 that the supply of removable printable labels 18 can be customized to contain specific information desired by the user. The user will begin by disconnecting the placement implement 14 from the supply of removable printable labels 18 by releasing the reusable attachment means 12. The supply of printable labels 18 can now be fed, unencumbered, into a laser printer or other printing equipment, which can be programed to print the desired information. The supply of printable labels 18 will then be attached to the placement implement 14 by threading the reusable attachment means 12 through the hole 24 and attaching the placement implement 14. The user will then continue to use the invention as described in the first embodiment of FIG. 1.

SUMMARY, RAMIFICATIONS, AND SCOPE

Accordingly, the reader will see that this system for correcting information on printed material using the removable printed or printable labels with attached implement for placement and method therefor of this invention would allow the user more controlled placement of a label onto existing printed materials, especially when the label is too small to allow for accurate, solely manual manipulation. The implement, because it is attached to the supply of labels, would be easier to find when its use is desire. The implement, because its only intended purpose is the handling of labels, would not require a sharp cutting edge. This narrowness of purpose would make it cheaper to produce and safer than other tools, such as a one-sided razor blade or an "X-ACTO" TM knife, which have sharp cutting edges.

The reader will also see that when generic information, such as a new area code, can be used by a large number of people, it would be cost and labor effective to produce large quantities of printed generic labels for use with this invention. It would also be advantageous to have blank, printable labels provided with this invention when the user needs to customize information.

Furthermore, the reader will see that because the placement implement of this invention is detachable and attachable, the user will enjoy the economy of replacing the supply of removable printed labels without having to repurchase the placement implement. The user will also be allowed the printing of blank, removable printable labels in any printing equipment.

Although the description above contains many specificities, these should not be construed as limiting the scope of the invention but as merely providing illustrations of some of the presently preferred embodiments of this invention. For example, the printed labels of this invention could have various configurations in regards to size, shape, styles of typeset and colours. The placement implement of this invention could have variations in size, style and material of composition.

The invention may be embodied in other specific forms without departing from the spirit or essential characteristics thereof. The present embodiments are therefore to be considered in all aspects as illustrative and not restrictive, the scope of the invention being indicated by the appended claims rather than by the forgoing description and all changes which come within the meanings and range of equivalency of the claims are therefore intended to be embraced therein.

What is claimed is:

1. A system for correcting information on printed material comprising:

a supply of removable, self adhesive labels;

implement placement means, comprising a pencil-shaped tool with a tapered, elongated tip, or tweezers, for placing said labels onto printed material;

reusable attachment means, comprising a key chain, or a releasable nylon tie, for attaching and detaching said implement to and from said labels.

2. The system of claim 1 wherein said labels are printed.

3. The system of claim 1 wherein said labels are printable.

4. A method of correcting information on printed material comprising the steps of:

selecting a supply of removable, self adhesive labels printed with correcting information and attached, by reusable attachment means, comprising a key chain, or a releasable nylon tie, to implement placement means, comprising a pencil-shaped tool with a tapered, elongated tip, or tweezers;

removing, with said implement, a single label from said supply;

aligning, with said implement, said label over inaccurate information on printed material;

pressing and adhering said label onto said inaccurate information thereby covering and correcting said inaccurate information.

5. A method of correcting information on printed material comprising the steps of:

selecting a supply of removable, self adhesive printable labels, attached, by reusable attachment means, comprising a key chain, or a releasable nylon tie, to implement placement means, comprising a pencil-shaped tool with a tapered, elongated tip, or tweezers;

detaching said supply from said implement using said reusable attachment means;

printing correcting information on said supply by sending said supply through a printer;

attaching said supply to said implement using said reusable attachment means;

removing, by implement placement means, a single label from said supply;

aligning, with said implement, said label over inaccurate information on printed material;

pressing and adhering said label onto said inaccurate information thereby covering and correcting said inaccurate information.

* * * * *